US006991535B2

(12) United States Patent
Ciepliski et al.

(10) Patent No.: US 6,991,535 B2
(45) Date of Patent: Jan. 31, 2006

(54) EXTERNALLY BAFFLED RIDGE VENT AND METHODS OF MANUFACTURE AND USE

(75) Inventors: Dustin Ciepliski, The Colony, TX (US); Jeff Hansen, Cedar Hill, TX (US)

(73) Assignee: Air Vent, Inc., Dallas, TX (US)

( * ) Notice: Subject to any disclaimer, the term of this patent is extended or adjusted under 35 U.S.C. 154(b) by 0 days.

(21) Appl. No.: 10/970,302

(22) Filed: Oct. 21, 2004

(65) Prior Publication Data

US 2005/0054284 A1 Mar. 10, 2005

Related U.S. Application Data

(63) Continuation-in-part of application No. 10/610,067, filed on Jun. 30, 2003, now Pat. No. 6,881,144.

(51) Int. Cl.
*F24F 7/02* (2006.01)

(52) U.S. Cl. ..... 454/365; 454/366; 52/199

(58) Field of Classification Search ..... 454/365, 454/366; 52/199, 198

See application file for complete search history.

(56) References Cited

U.S. PATENT DOCUMENTS

| | | | |
|---|---|---|---|
| 1,028,725 | A | 6/1912 | Hodgson |
| 1,717,728 | A | 6/1929 | Moore |
| 2,049,863 | A | 8/1936 | Palmer |
| 2,214,183 | A | 9/1940 | Seymour |
| 2,799,214 | A | 7/1957 | Roose |
| 2,868,104 | A | 1/1959 | Holt et al. |
| 2,988,980 | A | 6/1961 | Tschudin |
| 3,185,070 | A | 5/1965 | Smith |
| 3,236,170 | A | 2/1966 | Meyer et al. |
| 3,241,474 | A | 3/1966 | Rousey et al. |
| 3,303,773 | A | 2/1967 | Smith et al. |
| 3,326,113 | A | 6/1967 | Smith et al. |
| 3,481,263 | A | 12/1969 | Belden |
| D216,837 | S | 3/1970 | Swallow |
| 3,625,134 | A | 12/1971 | Smith |
| 3,660,955 | A | 5/1972 | Simon |
| 3,949,657 | A | 4/1976 | Sells |
| 4,073,106 | A | 2/1978 | Malott |
| 4,090,435 | A | 5/1978 | Vallee |

(Continued)

FOREIGN PATENT DOCUMENTS

| | | | |
|---|---|---|---|
| GB | 2186898 | A | 8/1987 |

OTHER PUBLICATIONS

"The Lomanco Balance", 1 sheet product literature.

(Continued)

*Primary Examiner*—Derek S. Boles
(74) *Attorney, Agent, or Firm*—Duane Morris LLP

(57) ABSTRACT

Ridge vents and methods of their use are provided. The preferred ridge vent includes an elongated flexible member having a central panel portion, a pair of lateral edges and a pair of transverse ends. A pair of vent openings are disposed proximate to said lateral edges. The central panel portion includes a plurality of support ribs for supporting the central panel portion above the roof. A pair of baffles is disposed laterally from the vent openings and the lateral edges. Each of the baffles is oriented in a first direction relative to the central panel portion for at least a period of time prior to installation and is oriented in a second direction relative to the central panel portion after the installation.

27 Claims, 14 Drawing Sheets

U.S. PATENT DOCUMENTS

| | | | |
|---|---|---|---|
| 4,252,590 | A | 2/1981 | Rasen et al. |
| 4,280,399 | A | 7/1981 | Cunning |
| 4,325,290 | A | 4/1982 | Wolfert |
| 4,342,807 | A | 8/1982 | Rasen et al. |
| 4,554,862 | A | 11/1985 | Wolfert |
| 4,643,080 | A | 2/1987 | Trostle et al. |
| 4,676,147 | A | 6/1987 | Mankowski |
| 4,782,743 | A | 11/1988 | Quinnell |
| 4,817,506 | A | 4/1989 | Cashman |
| 4,843,953 | A | 7/1989 | Sells |
| 4,903,445 | A | 2/1990 | Mankowski |
| 4,924,761 | A | 5/1990 | MacLeod et al. |
| 4,957,037 | A | 9/1990 | Tubbesing et al. |
| 5,009,149 | A | 4/1991 | MacLeod et al. |
| 5,070,771 | A | 12/1991 | Mankowski |
| 5,094,041 | A | 3/1992 | Kasner et al. |
| 5,095,810 | A | 3/1992 | Robinson |
| 5,112,278 | A | 5/1992 | Roberts |
| 5,122,095 | A | 6/1992 | Wolfert |
| 5,149,301 | A | 9/1992 | Gates |
| 5,167,579 | A | 12/1992 | Rotter |
| 5,288,269 | A | 2/1994 | Hansen |
| 5,457,920 | A | 10/1995 | Waltz |
| 5,458,538 | A | 10/1995 | MacLeod et al. |
| 5,542,882 | A | 8/1996 | Sells |
| 5,673,521 | A | 10/1997 | Coulton et al. |
| 5,772,502 | A | 6/1998 | Smith |
| 5,797,222 | A | 8/1998 | Martin |
| 6,128,869 | A | 10/2000 | Brotherton et al. |
| 6,149,517 | A | 11/2000 | Hansen |
| 6,227,963 | B1 | 5/2001 | Headrick |
| 6,233,887 | B1 | 5/2001 | Smith |
| 6,260,315 | B1 | 7/2001 | Smith |
| 6,302,785 | B1 | 10/2001 | McKinney et al. |
| 6,308,472 | B1 | 10/2001 | Coulton et al. |
| 6,361,434 | B1 | 3/2002 | Brandon |
| D456,531 | S | 4/2002 | O'Hagin |
| 6,371,847 | B2 | 4/2002 | Headrick |
| 6,450,882 | B1 | 9/2002 | Morris et al. |
| 6,684,581 | B2 | 2/2004 | Robinson et al. |
| 2001/0019941 | A1 | 9/2001 | Headrick |
| 2002/0100232 | A1 | 8/2002 | Robinson et al. |
| 2003/0046878 | A1 | 3/2003 | Zdeb et al. |
| 2004/0088928 | A1 | 5/2004 | Headrick, II et al. |
| 2004/0088932 | A1 | 5/2004 | Headrick |

OTHER PUBLICATIONS

Ridge Vent performance, Tales from the Attic, Air Vent Inc. product literature, 2 pages.

Solar Group, Inc. Shingle-Over, product literature, 2 pages.

Lomanco® LOR-30 Shingle Over Ridge Vent, product literature, 2 pages.

Lomanco® OmniRoll OR-20 Shingle Over Ridge Vent product literature, 1 page.

EXTERNALLY BAFFLED RIDGE VENT AND METHODS OF MANUFACTURE AND USE

CROSS-REFERENCE TO RELATED APPLICATION

This application is a continuation-in-part of U.S. patent application Ser. No. 10/610,067 to Dustin Ciepliski and Jeff Hansen, entitled "Externally Baffled Ridge Vent and Methods of Manufacture and Use" filed Jun. 30, 2003, now U.S. Pat. No. 6,881,144, the entirety of which is hereby incorporated by reference herein.

FIELD OF THE INVENTION

The present invention is related generally to ridge vents for covering the opening of the roof ridge, and more particularly to rollable, baffle and ridge vent assemblies.

BACKGROUND OF THE INVENTION

In the winter, household activities, such as cooking, showering and doing the laundry, generate moisture that can damage the attic insulation and building materials of the roof. In the summer, attic temperatures can rise to over 150° F., which can cause premature aging and cracking of wood and roofing materials. These elevated temperatures can also increase cooling costs for the home owner. In the construction of rooves, therefore, it is often desirable to provide a ventilation opening at the roof ridge and cover it with a vent. Ridge vents are passive ventilation systems which provide openings through which air can convectively flow to and from under the roof structure to provide ventilation.

Ridge vents typically cover any elongated opening, such as one that is formed in a roof and that extends along the peak of the roof, with the opening typically being in the range of about 10–20 cm in width and running along a substantial portion of the roof peak. Typical ridge vents include "shingle-over roof ridge vents" and exposed roof vents. See for example U.S. Pat. Nos. 6,361,434; 6,233,887; 6,450,882; 6,260,315 and published U.S. application 2002/0100232A1, all of which are incorporated herein by reference.

Many ridge vents have been developed that are made of polymeric materials that are flexible along a longitudinal axis in order to permit the ridge vent to conform to the sloped sides of a roof to cover the ridge opening. These ridge vents typically include a plurality of vents and supporting structures that depend from a common panel and that serve both the functions of resisting entry of precipitation, insects, and foreign manner, while providing supportive structures that lift the panel away from the roof and provide crush resistance. It is further desirable that ridge vents have means to create a "Venturi effect" or air draft to draw hot air outwardly from the underlying attic.

Prior art roof ridge vents are known that can be rolled for compact packaging and transport to an installation site. However, to make these ridge vents rollable requires some sacrificing of thermal efficiency in drawing hot air from the underlying attic, or costly modifications to the baffle structure in order to allow the ridge vent to be rolled in a spiral form. See U.S. Pat. No. 6,233,887 col. lines 50–61 and col. to lines 45–55.

Accordingly, there remains a need for a ridge vent, and particularly a rollable roof ridge vent which can be made cost-effectively, and which efficiently assists convection of heat and moisture from beneath a roof.

SUMMARY OF THE INVENTION

Ridge vents and methods of their use are provided. In a first embodiment, the preferred ridge vent includes an elongated flexible member having a central panel portion, a pair of lateral edges and a pair of transverse ends. A pair of vent openings are disposed proximate to the lateral edges. The central panel portion includes a plurality of support ribs for supporting the central panel portion above the roof. A pair of baffles is disposed laterally from the vent openings and the lateral edges. Each of the baffles is oriented in a first direction relative to the central panel portion for at least a period of time prior to installation and is oriented in a second direction relative to the central panel portion after the installation.

In a preferred embodiments, the roof ridge vent can be molded such that the baffles become generally parallel with (e.g., ±30°) the central panel when rolled. The baffle are then orientated in a more vertical position with respect to the central panel portion during installation, either manually or naturally by the shape or design of the baffle itself.

In one embodiment, the baffles are pivotally coupled to the lateral edges of the central panel portion. The baffles can be locked in vertical orientation by the use of clips or other securing means. The baffles can also be vertically oriented externally by imposing stresses, or reinforcing ribs, for example, in the right locations during the molding or fabrication of the ridge vent. In this manner, the baffles can be oriented in a flattened position when the vent is rolled, and then they can spring back once the vent is unrolled. These stresses, and/or reinforced portions of the vent, can help insure that the baffle is always naturally in a vertical orientation once installed, thereby reducing instances of improper installation.

BRIEF DESCRIPTION OF THE DRAWINGS

The accompany drawings illustrate preferred embodiments of the invention as well as other information pertinent to the disclosure, in which.

DETAILED DESCRIPTION OF THE INVENTION

Figure 1:
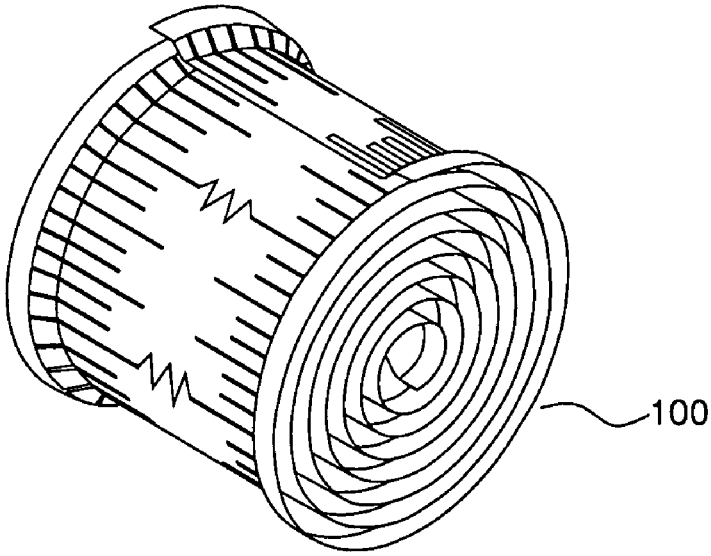
FIG. 1 is a front perspective view of a rolled ridge vent of the present invention.

This invention provides ridge vents which can be used in shingle-over roof vent applications, roll-out shingle over roof ridge vent applications, and in the applications where shingles are not employed over the vent. In addition, methods of installing these ridge vents, and methods of manufacturing them are provided. The roof vents of this invention can be designed for ridge and hip roof applications, they can have a low profile for a minimum accented ridge line. The vent opening or louver openings are preferably designed to keep out insects and weather infiltration, and the external baffles are desirably structured to deflect wind and rain and create negative air pressure ("Venturi effect"). The air vents of this invention create a balanced system of intake and exhaust through the attic for provided greater airflow than conventional roof vents or turbine vents. The preferred external baffles are desirably molded into the roof vent in such a way that they can be readily rolled into a coil, laid out over an opening in a roof vent, and positioned in their final form easily, and without significant additional cost to the installer.

With respect to the drawings, and in particular, FIGS. 1–5 thereof, a ridge vent 101 is provided for covering an opening of a roof ridge. The ridge vent 101 is preferably rollable into a spiral coil 100, but can be equally provided in a fixed or more rigid form.

The ridge vent 101 includes an elongated flexible member having a central panel portion 11, a pair of longitudinal side portions and a pair of transverse ends. The central panel portion 11 includes a plurality of support ribs 18 for supporting the central panel portion 11 above a roof. Each of the side portions contains a plurality of channels, e.g., formed by the support ribs 18, for directing air current, a vent opening, and a baffle 14 disposed laterally from the vent opening. The baffles 14 are originally disposed in a first direction, for example in a relatively flat position, or substantially parallel (±30°) with the proximate central panel portion 11 or roof, for at least a period of time prior to insulation, and are then oriented in a second direction, which is generally perpendicular to (±30°) or upright in relation to the roof or proximate central panel portion 11.

Figure 2:
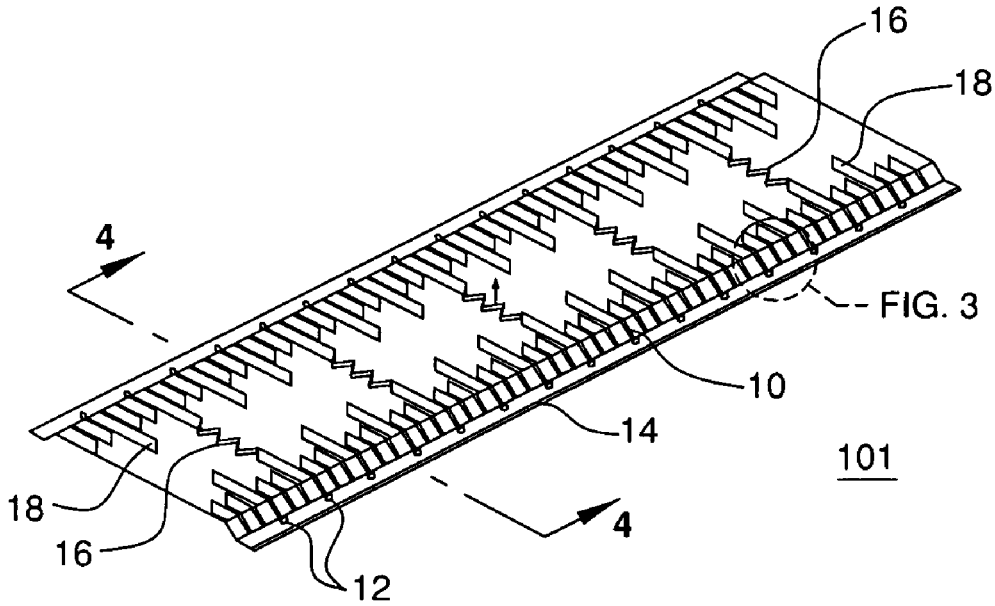
FIG. 2 is a top perspective view of the preferred ridge vent, in which the top of the central panel portion has been cut away.
Figure 3:
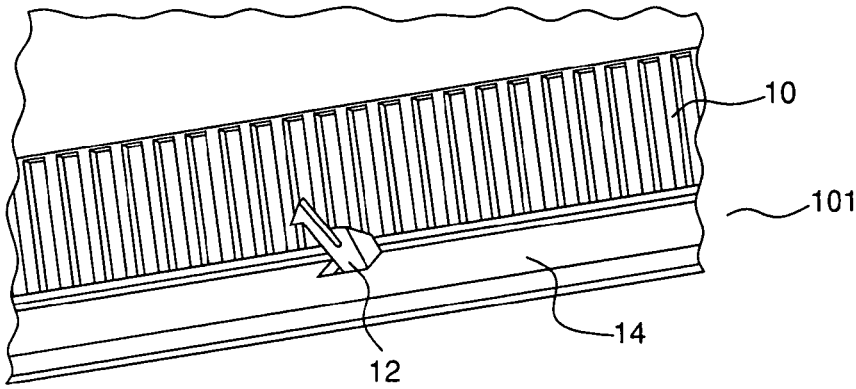
FIG. 3 is an enlarged view of the louver and baffle portion of the ridge vent of FIG. 2, showing a preferred clip for creating a fixed distance between the baffle and the louvers.
Figure 4:
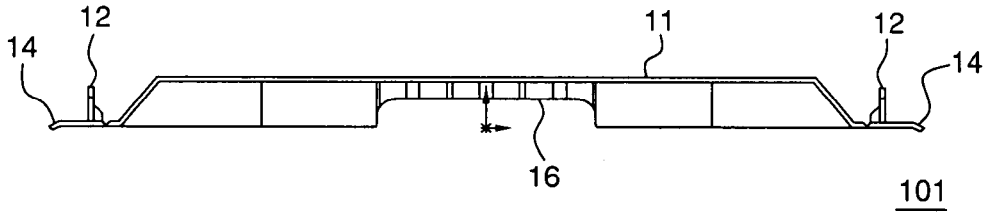
FIG. 4 is a cross-sectional side plan view, taken through line 4—4, of the ridge vent section of FIG. 2, without the cutout.
Figure 5:
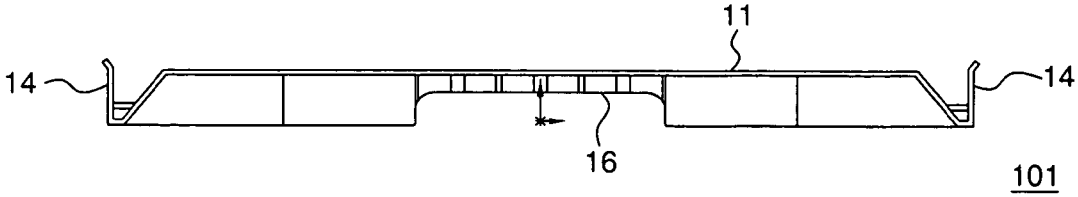
FIG. 5 is a side-plan view of the ridge vent cross-section of FIG. 4, showing the baffles disposed in their final position.

The ridge vent 101 embodiment of this invention is preferably constructed from a polymer material, such as polypropylene, polyvinylchloride, or polyethylene, and more preferably from high impact copolymer polypropylene. The ridge vent 101 laid over, or roll 100 can be unrolled over an opening in a roof ridge. The central panel portion 11 preferably includes a plurality of support ribs 18 which in the most preferred embodiment are about 1/16" in thickness and about 2–4" in length. Preferably, the ribs alternate in 2" or 4" lengths as shown in FIG. 2 forming channels there between. The support ribs 18 preferably terminate laterally in a sloping surface, coextensive with a vent opening. The vent opening is preferably protected by a series of louvers 10, but a screen or partially obstructed opening of any kind will do. The louvers 10 and channel desirably direct air current from under the roof and from the outside to the attic. The louvers 10 are preferably inclined at about 45° from the central panel 11. Extending from the bottom of the longitudinal side portions of the elongated flexible member are baffles 14, which are preferably integrally molded with the ridge vent 101, but can be separately attached to the ridge vent, such as by, adhesive, melting bonding or ultrasonic welding. The slots in the vent opening are preferably between 1/16–1 1/4" in width, and are designed to keep out insects and weather infiltration, such as snow, rain and hail.

The external baffles 14 are most desirably integrally formed with the ridge vent 101, and form a portion of the longitudinal side portions of the ridge vent 101. They are designed to deflect wind and rain and create negative air pressure, or a Venturi effect to draw hot air outwardly from within the underlying attic. In most rollable ridge vents, the baffle is a separate item which is inserted under the ridge vent during installation. In U.S. Pat. No. 6,361,434, a rollable baffle and ridge vent combination is disclosed. The ridge vent of the '434 patent includes a fixed baffle having a plurality of deformed triangles to permit it to collapse in accordion fashion upon itself during rolling. A similar undulated sidewall in the baffle to permit the vent to be rolled without significant distortion is disclosed in Smith, U.S. Pat. No. 6,260,315. In the preferred embodiment 101 of the present invention, the baffle is preferably manufactured with the vent in a one piece construction with the baffle oriented in a first direction, followed by maneuvering the baffle 14, either manually or naturally, into a second operable direction during the installation of the ridge vent on a roof ridge opening. This permits the roof vent to be rolled much more easily, and permits more cost-efficient manufacturing methods, such as index injection molding.

Figure 8:
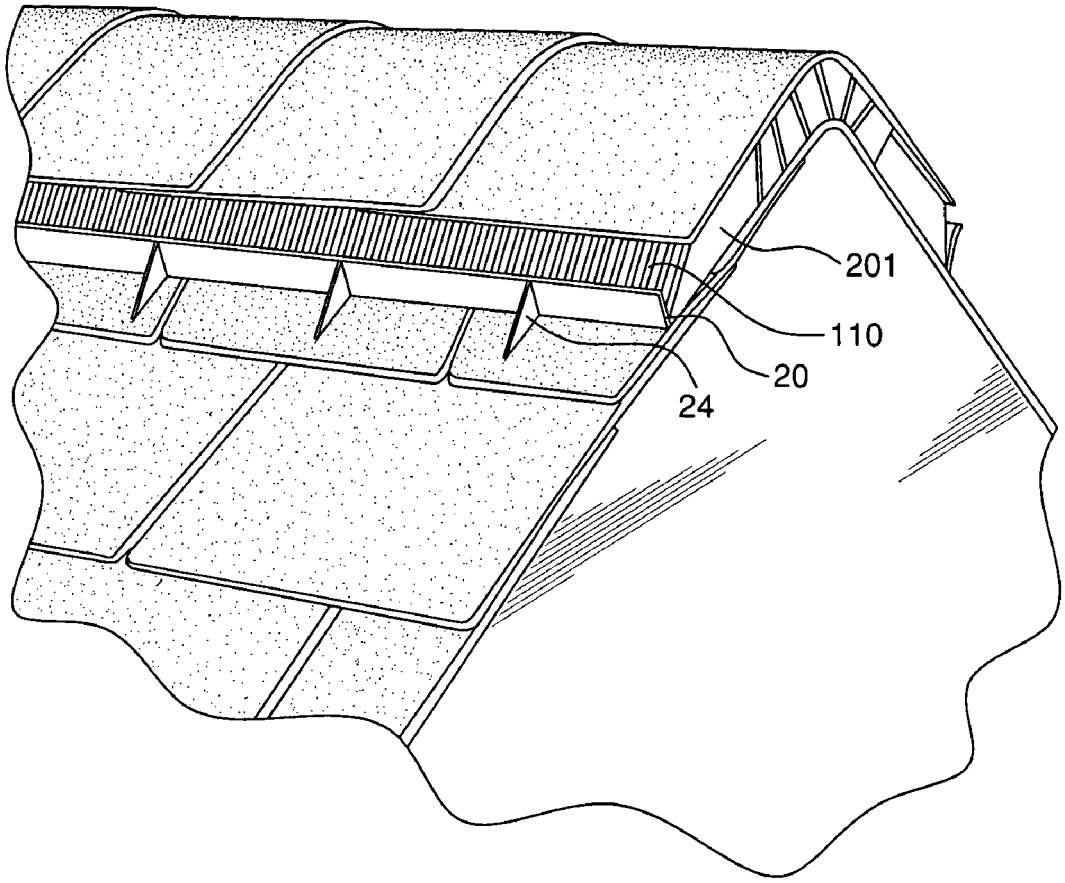
FIG. 8 is a front perspective partial view of a roof ridge employing the roof vent of FIG. 7 and a shingle—over vent construction.

With respect to the details of FIG. 2–5, the preferred ridge vent 101 further includes an internal gusset 16 for connecting selective supporting ribs 18 in the central panel portion 11 of the ridge vent 101. A plurality internal gussets 16 are desirably molded or manufactured at the same time as the remaining portions of the ridge vent 101, and can contain the same polymer composition, a different or more rigid polymer composition, or a metallic insert for example. As shown in the enlarged view of FIG. 3, the baffles 14 can include optional louver spacer clips 12 which can clip between louvers 10, or rest on a surface of a louver 10, or some other vent surface, to provide a predesignated spacing between the baffles 14 and the louvers 10 to create the desired negative air pressure or Venturi effect. In the ridge vent embodiment 101 of FIGS. 4 and 5, the baffles are oriented in a generally flat position with their louver spacer clips 12 being substantially perpendicular to the central portion 11. The baffles 14 at this time, are generally parallel with the surface of the central portion 11 or the roof, if installation is imminent. Following the unrolling of the ridge vent roll 100 into a position on a ridge opening, the baffles 14 are moved from a first orientation to a second orientation, which is generally perpendicular to the nearest or proximate central portion 11 and, which is also generally perpendicular to the roof, as shown in FIG. 8. The louver spacer clips 12 can be intermittently disposed along the baffle 14, in a preferred spacing of about 12". The clips 12 can be integrally formed in the vent mold, or separately attached as described herein connection with the baffles 14.

Figure 6:
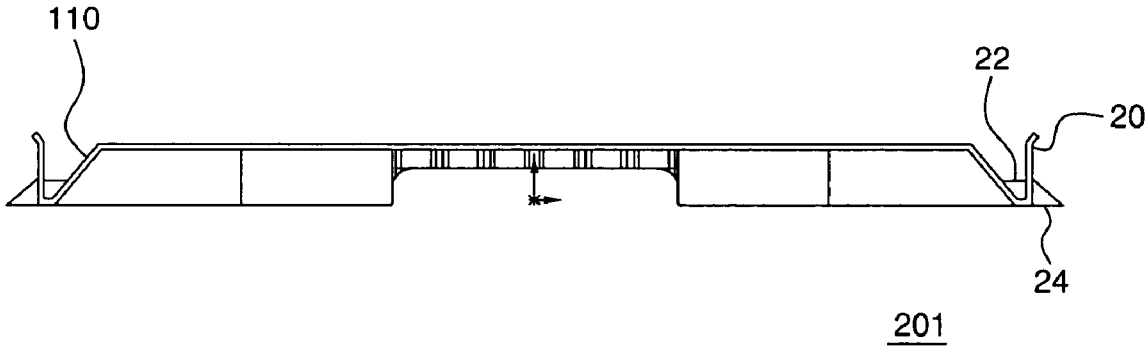
FIG. 6 is a side plan, cross-sectional view of an additional ridge vent of this invention employing a different baffle construction.
Figure 7:
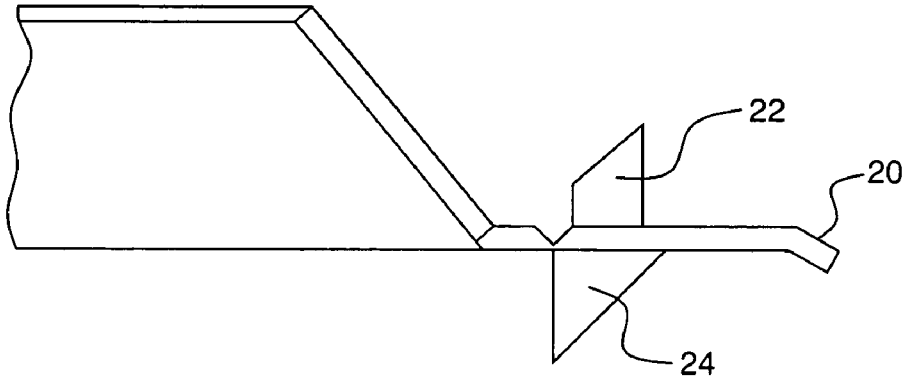
FIG. 7 is a side perspective, partial and cross-sectional view of the additional baffle support of FIG. 6 for use in disposing the baffle in an upright position.

An alternative baffle design of ridge vent 201 is shown in FIGS. 6–8. The alternative baffle 20 is also preferably oriented in a first direction prior to use, and in a second direction, after it is installed, such as disclosed in FIGS. 6 and 7. The alternative baffle 20 includes a louver spacer portion 22 and a baffle support 24. As shown in FIG. 7, the louver spacer portion 22 aligns with the generally 45° surface of the louvers 10, while the baffle support 24 forms a base with the roof surface, and is generally parallel thereto, as shown in FIGS. 7 and 8. The louver spacer portion 22 and baffle supports 24 are preferably integral with the baffle 20 and are also spaced about 12" apart along the baffle 20.

The ridge vents 101 of this invention are relatively easy to install in shingle over ridge vent or standard applications. In the preferred embodiment, the ridge vent 101 is unrolled and disposed over an opening of a roof ridge. The baffles 14 are flexed, or otherwise reoriented, from a first direction to a second direction relative to the central panel portion 11, the roof, or both, as shown in FIGS. 4–8. Preferably the orientation step includes applying a support means for assisting the baffles to achieve the second position. In the preferred embodiments of this invention, the support means may be manual support means, such as clips, fasteners or stand-offs, or natural support means, such as employing ribs or areas of stress in the flexible member or ridge vent so that the baffles orient themselves while being applied to a roof ridge. Preferably laying the ridge vent 201 on a roof, causes contact between the baffle supports 24, which forces, or bends, baffles 20 into a position which is more vertical. Alternatively, a combination of manual and natural support means can be employed.

In the shingle-over ridge vent installation methods of this invention, a plurality of shingles can be disposed over a portion of the ridge vent 201 and both the ridge vent and the shingles can be simultaneously nailed to a roof substrate, such as plywood, studs, tongue and groove planks, or the like, to secure both the roof vent 201 and shingles in place. In the installation shown in FIG. 8, the shingles are layered over the fasteners of the adjacent shingle, such as to minimize exposure to water leakage. The shingles are preferably layered so as to leave the vent opening, or louvers 110, open. They should also not interfere with the Venturi action caused by the baffles 20. The ridge vent 201 can further include a foam insert (not shown), which can seal the end of the vent prior to completion of the installation.

Figure 9:
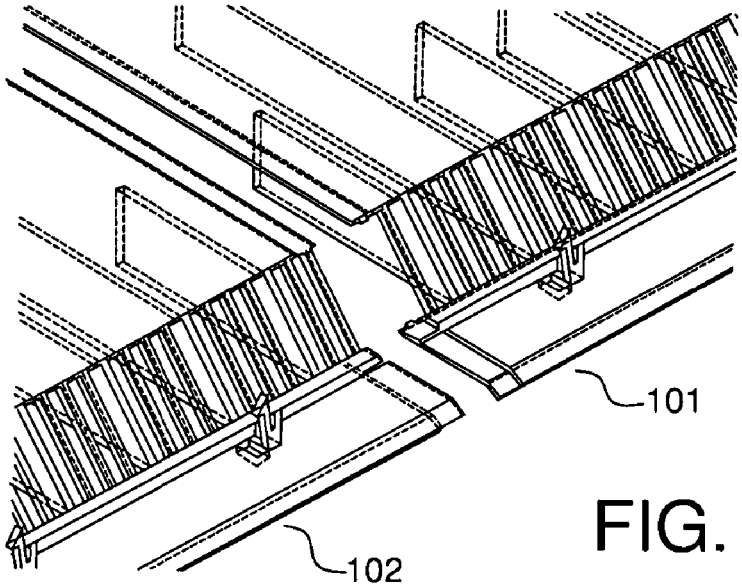
FIG. 9 is a front perspective phantom drawing of an index molding connection between two ridge vent sections.
Figure 10:
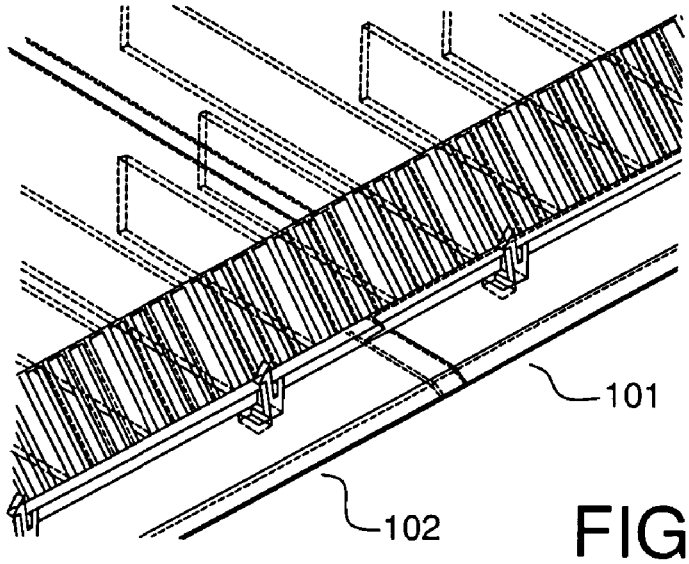
FIG. 10 is a front perspective phantom drawing of the ridge vent sections of FIG. 9 being melt bonded together.

This invention also contemplates a more efficient manufacturing process for making ridge vents, a shown in FIGS. 9 and 10. The preferred method includes a forming operation employing polymeric materials. The forming operation can include injection molding, extrusion or compression molding, for example. In a preferred embodiment, the ridge vent is made by index injection molding. In such a preferred embodiment, a mold 102 having upper and lower mold sections, shown in phantom in FIG. 9 is provided for forming a mold cavity. A quantity of polymeric material is disposed in the mold cavity and a first ridge vent section 101, also shown in phantom is formed in the mold cavity. Next, the first ridge vent section 101 is indexed so that it is substantially moved beyond the mold cavity but remains in contact with the mold 102. As shown in FIG. 10, a small stepped extension formed in the baffle 14 and central panel 11, can remain in the mold 102. Finally, a second quantity of polymer is disposed between the mold sections of mold 102 and a second ridge vent section is formed which is connected to the first ridge vent section 101. The cooled first ridge vent section can then be rolled up in lengths containing about 20–50 feet of vent material, which is then packaged in a paper or polyethylene wrap.

Figure 11:
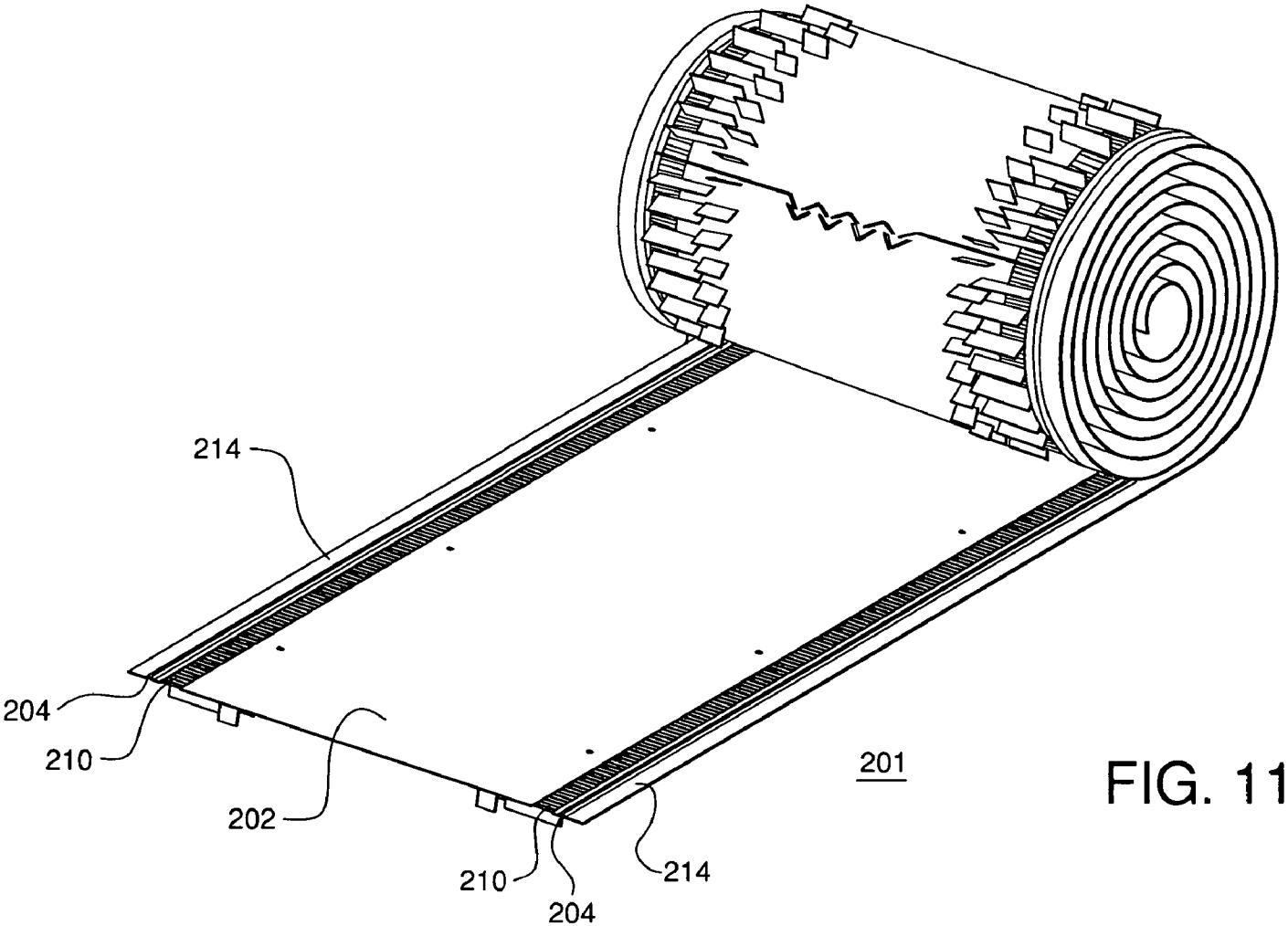
FIG. 11 is a top perspective view an alternative embodiment of a rollable ridge vent (shown partially rolled) employing an alternative baffle construction.
Figure 11A:
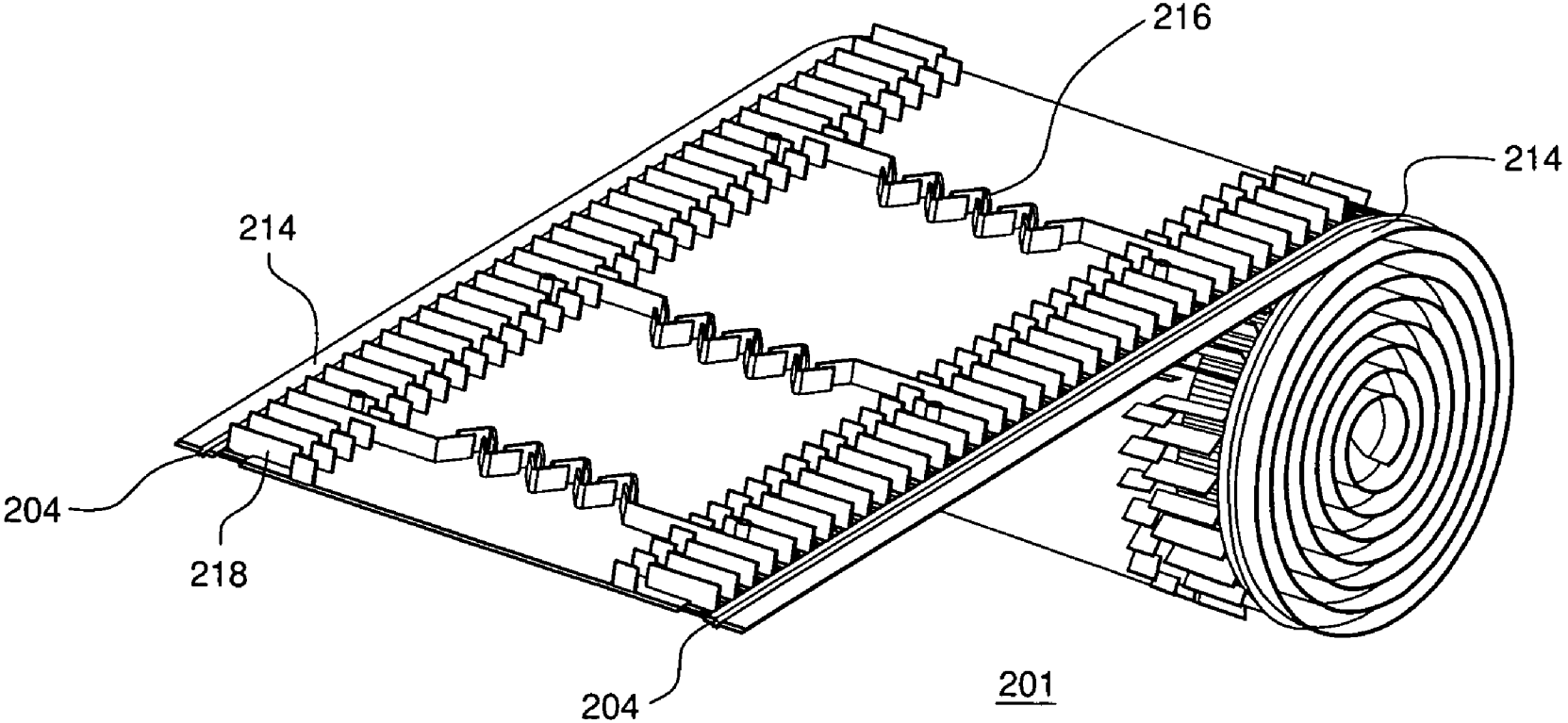
FIG. 11A is a bottom perspective view of the rollable ridge vent of FIG. 11A.
Figure 11B:
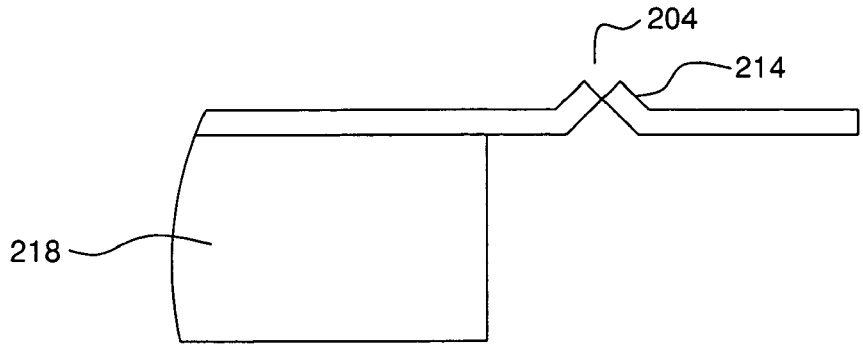
FIGS. 11B, 12A, and 13A are enlarged, partial side plan views of the rollable ridge vent of FIG. 11 showing a baffle in various orientations.

FIGS. 11 and 11A are top and bottom perspective views, respectively, of an alternative embodiment of a rollable ridge vent 201. Like ridge vent 101, rollable ridge vent 201 includes an elongated flexible member having a central panel portion 202, a pair of lateral edges 204 and a pair of transverse ends. In one embodiment, the central panel portion is generally planar when unrolled between the lateral edges 204. A pair of vent openings 210, preferably slotted vent openings, are disposed laterally inwardly from the lateral edges 214. In a preferred embodiment, the vent openings are formed in and through the central panel portions 202, as shown, and proximate to lateral edges 204. The slots in the vent opening are preferably between 1/16–1¼" in width, and are designed to keep out insects and weather infiltration, such as snow, rain and hail. As shown in FIG. 11A, the central panel portion 202 also includes a plurality of support ribs 218 for supporting the central panel portion 202 above the roof. The central panel portion 202 can also include a plurality of spaced gussets 216 distributed on the bottom surface thereof A baffle 214 is pivotally connected to each lateral edge 204. As shown in FIGS. 11 and 11A and the enlarged, partial side plan view of FIG. 11B, the baffles 214 are generally oriented in a first direction substantially parallel (±30°) to the proximate, top major surface of the central panel portion 202 prior to installation, such as when the ridge vent 201 is rolled or being rolled. Although rollable ridge vent 201 of FIGS. 11 and 11A is shown in a partially rolled state, this is for illustrative purposes only. As described below, baffles 214 are preferably not oriented in the same plane with the central panel portion once the ridge vent is unrolled, but rather are oriented in a more vertical orientation to the central panel portion when the ridge vent is unrolled. FIGS. 11 and 11A illustrate the orientation that the baffles 214 naturally take as the ridge vent is flexed during rolling and when the ridge vent is completely rolled, with the top major surface of central panel portion 202 being rolled on itself, i.e., with the support ribs 218 and gussets 216 on the outside of the roll like the embodiment shown in FIG. 1.

Figure 12A:
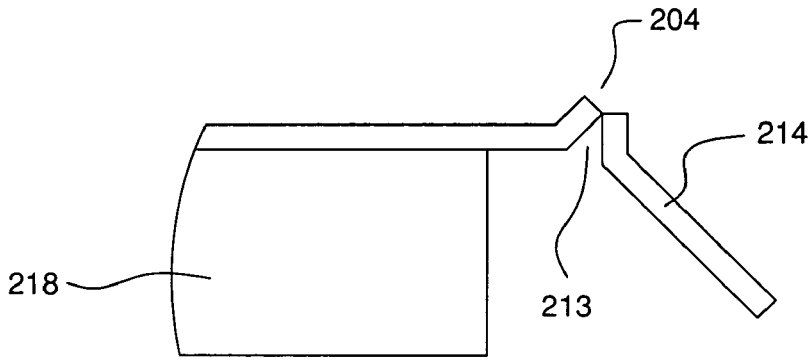
Figure 13A:
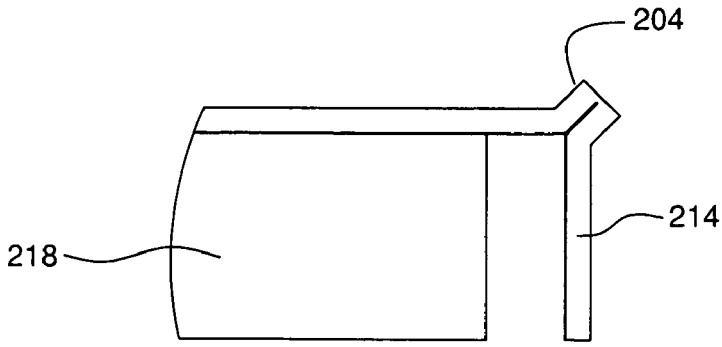
Figure 12:
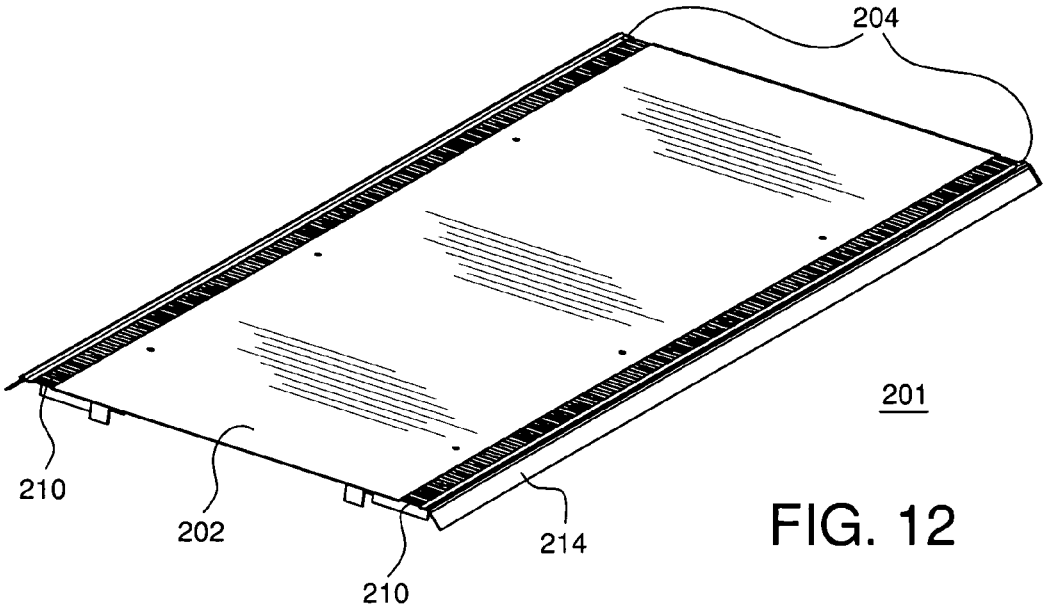
FIGS. 12 and 13 are top perspective views of the ridge vent of FIG. 11A showing the baffle in alternative orientations.
Figure 13:
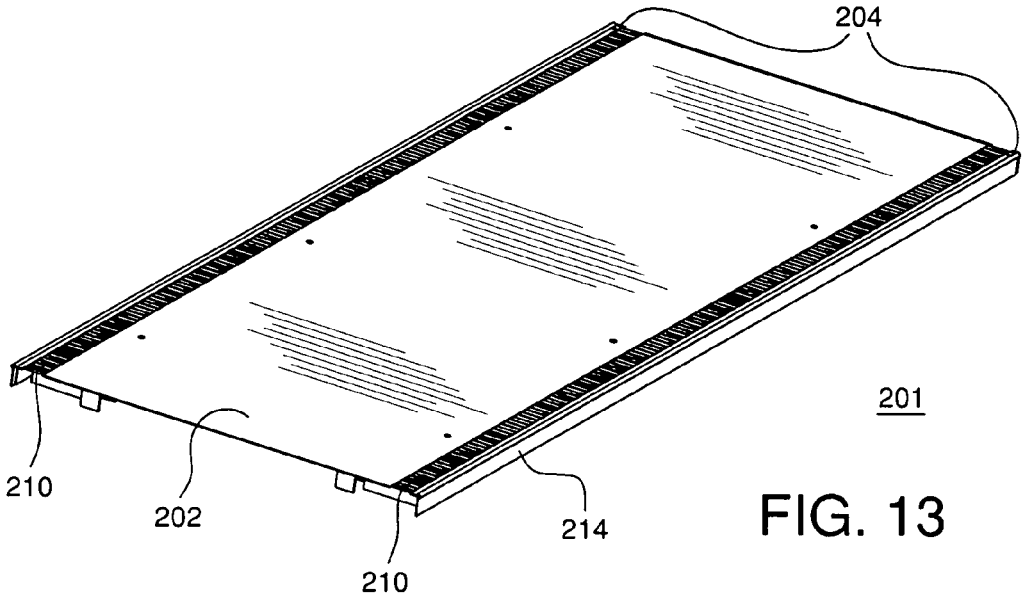

FIGS. 12, 12A and FIGS. 13, 13A illustrate embodiments of the rollable ridge vent 201 once unrolled. More specifically, these figures illustrate the baffles 214 being oriented in a second direction for installation once the ridge vent 201 is unrolled. FIGS. 13 and 13A illustrate the baffles 214 being substantially perpendicular, i.e., at an angle of or about 90° (e.g., 80–100°), to the central panel portion 202. It is preferred that the ridge vent is molded in such a way so that the ridge vent has a natural tendency to orient itself in the direction shown in FIGS. 13 and 13A once unrolled. However, it is believed that depending on, for example, how long the ridge vent remains rolled (such as during storage thereof) and the polymer used, the baffles may self orient in a direction short of perpendicular, such as shown in FIGS. 12 and 12A, due to, for example, polymer memory. In any event, this second direction is preferably between about 30–120° relative to the plane of top central panel portion when flat and before it is applied to a roof's apex, and more preferably 45–90° relative to the central panel portion, and still more preferably 75–90° relative to the central panel portion.

Regardless of the orientation direction of the baffles 214 once the rolled ridge vent is unrolled, because the baffles 214 are pivotally connected to the lateral edges 204 of the central panel portion 20, they can be pivoted into a desired more vertical second direction relative to the flat central panel portion for installation. If this preferred installation second direction is not the natural orientation that the baffles take once the ridge vent 201 is unrolled, or if more rigidity is desired, clips or other fasteners, such as described above in the embodiment of FIGS. 3–5, may be provided to lock the baffles 214 into a desired orientation when installed, such as the perpendicular orientation shown in FIGS. 13 and 13A. Alternatively, an adhesive strip, for example, a two sided pressure sensitive adhesive tape having a release paper strip, can be applied in the gap 213 shown in FIG. 12A. In the field, the release paper can be removed and the tape can secure the baffle 214 to the corner 204 in the position shown in FIG. 13A.

Figure 19:
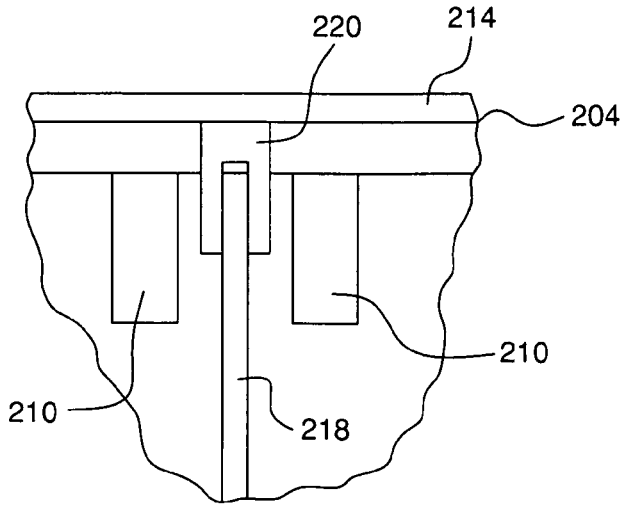
FIG. 19 is a enlarged, partial bottom plan view of an embodiment of a rollable ridge vent with a clip for securing the baffle in a desired position.

In one embodiment, spaced clips or fasteners 220 can be disposed to clip onto an adjacent support rib 218 to secure the baffles 214 in the desired position. This embodiment is shown in the enlarged, partial bottom plan view of FIG. 19.

Figure 16:
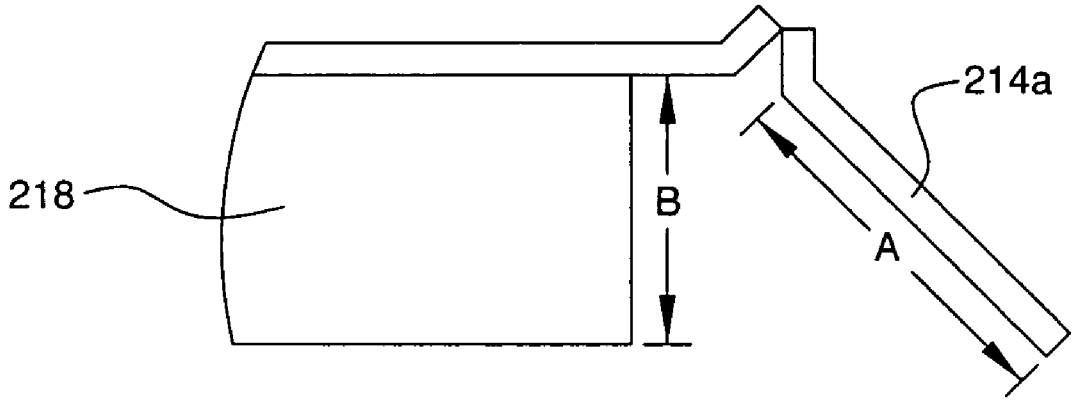
FIG. 16 is an enlarged, partial side plan view of a ridge vent showing an alternative embodiment of a baffle.
Figure 17:
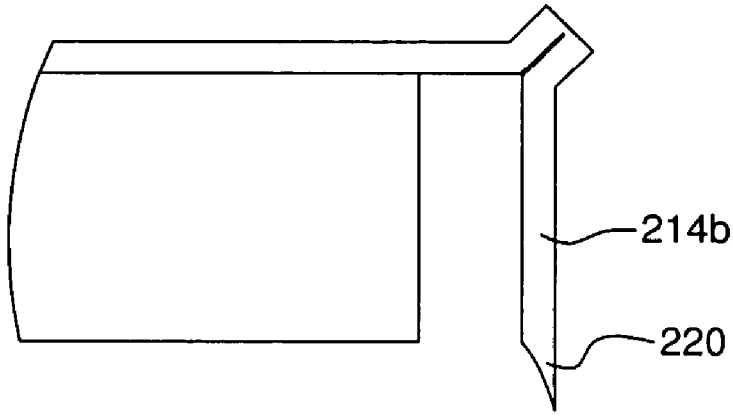
FIG. 17 is an enlarged, partial side plan view of a ridge vent showing another alternative embodiment of a baffle.

FIGS. 16 and 17 are partial, enlarged side plan views illustrating alternative embodiments of rollable ridge vents. In the embodiment of FIG. 16, baffle 214*a* has a height A that is greater than the height B of the support ribs 218. This embodiment may be desired when the baffle 214*a* naturally orients itself in a direction that is short of perpendicular to the central panel portion once the ridge vent is unrolled. The additional length (length A minus length B) is sufficient such that the baffle 214 is long enough to contact the roof when the ridge vent is installed and the baffle is at an angle of less than 90° to the central panel portion. In one exemplary embodiment, length A is about 0.75" and length B is about 0.58", meaning the baffle portions 214 are about 0.17" longer than the support ribs 218. This embodiment helps prevent the undesired entrance of wind driven debris, pests, etc. . . . under the baffle 214*a* by providing a good seal against the roof. This embodiment also provides a better interface between the roof and ridge vent for application of an additional caulking seal between the roof and the ridge vent, if desired.

Figure 18:
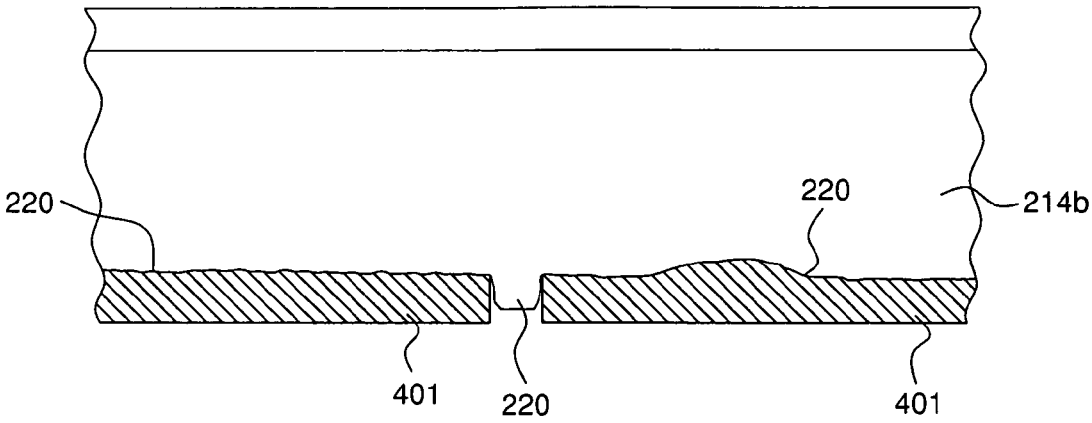
FIG. 18 is an enlarged, partial cross-sectional view showing a roof installation including the ridge vent of FIG. 17.

In the embodiment of FIG. 17, the baffle 214*b* includes a deformable pliable portion 220 disposed towards a bottom edge of the main body portion of the baffle 214*b*. This portion 220 may comprise an ultra-thin piece of plastic, such as 20–30 thousandths of an inch in thickness. In one embodiment, the main body portion of baffle 214*b* is about 70 thousandths of an inch in thickness. This thin portion may be formed by forming or leaving intact flash plastic formed at mold seams during the molding process. The pliable portion 220 may be conformed to the contours of the roof, and more specifically the roof shingles, when the roof ridge vent is installed, thus creating a seal between the roof and the baffle. Simple downward pressure on the baffles during installation should be sufficient to create the desired deformations in the pliable portions 220. This seal may also be reinforced by caulking. FIG. 18 is a partial front plan view of a roof ridge vent of this embodiment installed on a roof. As shown in FIG. 18, portion 220 conforms itself to the general contours of shingles 401 and spaces therebetween. This embodiment also helps prevent the undesired entrance of wind driven debris, pests, etc. . . . under the baffle 214*b*, while also providing an improved interface for application of a caulk seal, if desired, or even replacing a caulk seal, thereby reducing labor and installation time.

Figure 14:
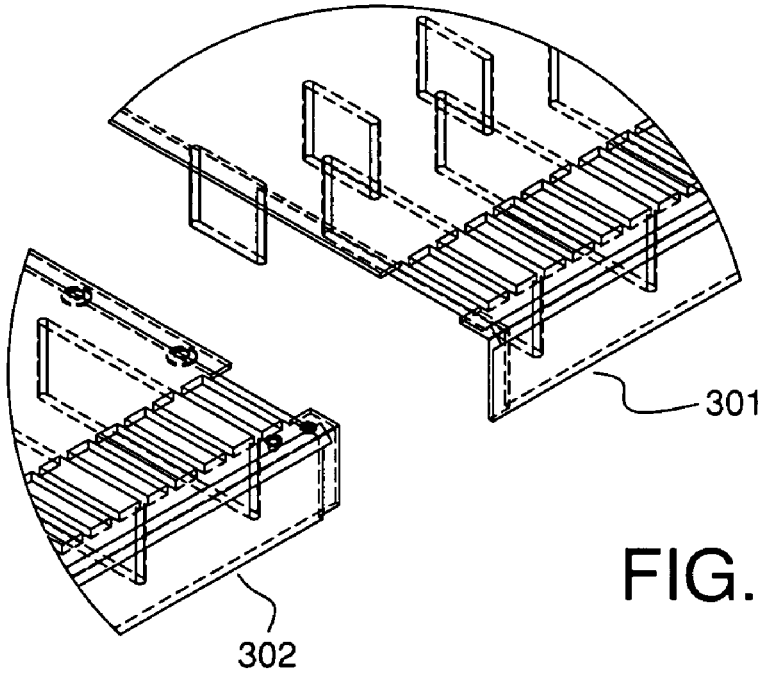
FIG. 14 is a front perspective phantom drawings of an index molding connection between two ridge vents.
Figure 14A:
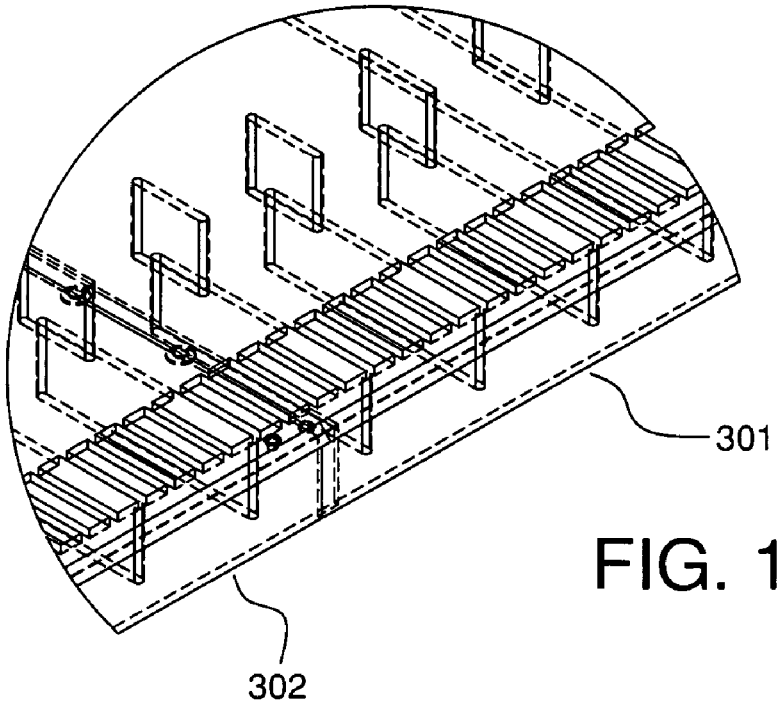
FIG. 14A is a front perspective phantom drawings of the ridge vent sections of FIG. 14 being melt bonded together.

The forming operation for forming the rollable ridge vent 201 can include injection molding, extrusion or compression molding, for example. In a preferred embodiment illustrated in FIGS. 14 and 14A, the ridge vent is made by index injection molding. In such a preferred embodiment, a mold 302 having upper and lower mold sections, shown in phantom in FIG. 14 is provided for forming a mold cavity. A quantity of polymeric material is disposed in the mold cavity and a first ridge vent section 301, also shown in phantom, is formed in the mold cavity. Next, the first ridge vent section 301 is indexed so that it is substantially moved beyond the mold cavity but remains in contact with the mold 302. As shown in FIG. 14*a*, a small stepped extension formed in the baffle 214 and central panel 202, can remain in the mold 302. Finally, a second quantity of polymer is disposed between the mold sections of mold 302 and a second ridge vent section is formed which is connected to the first ridge vent section 301. The cooled first ridge vent section can then be rolled up in lengths containing about 20–50 feet of vent material, which is then packaged in a paper or polyethylene wrap.

Figure 15:
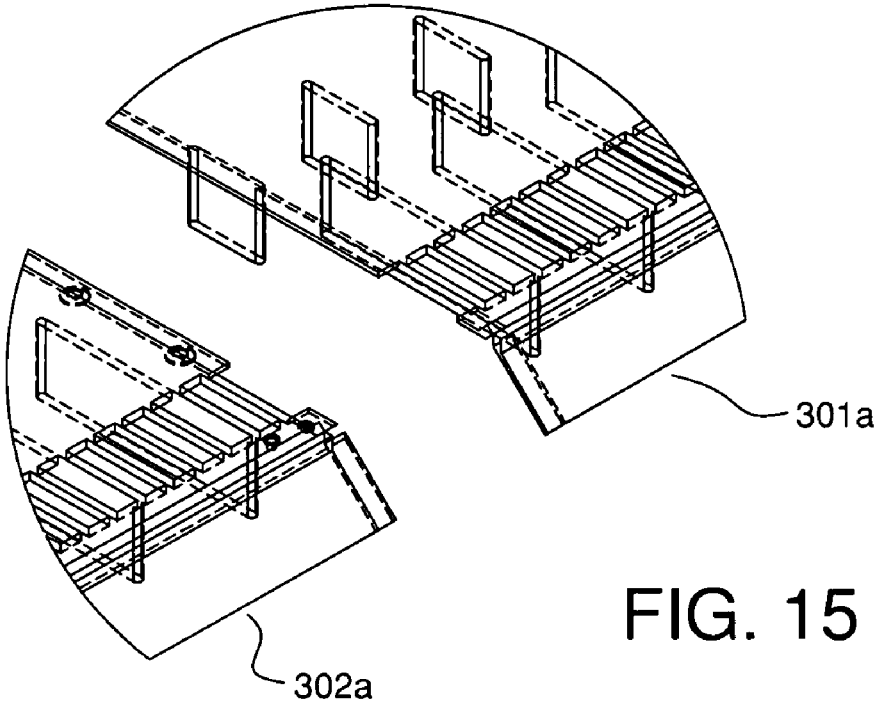
FIGS. 15 and 15A illustrate alternative embodiments of the index molding connection and melt bond connection, respectively, of FIGS. 14 and 14*a;*
Figure 15A:
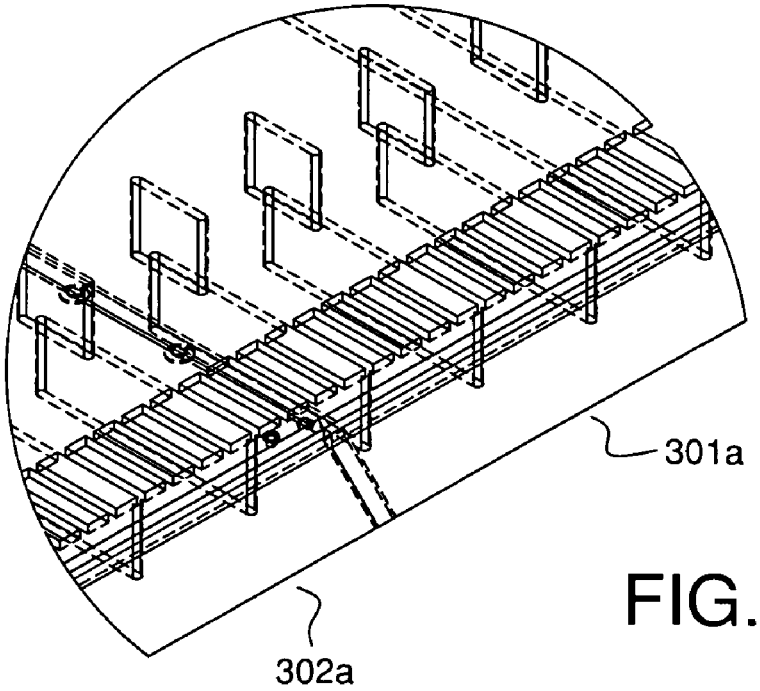

As shown in FIGS. 14 and 14A, the baffles 214 can be formed to have an initial orientation of at or about 90° to the central panel portion 202. In some embodiment, the baffles are initially formed at an oblique angle with respect to the central panel portion 202. The method of forming this embodiment of the rollable ridge vent is illustrated in FIGS. 15 and 15A, with mold 302*a* and ridge vent section 301*a*. The method of FIGS. 15 and 15*a*, other than the orientation of the formed baffle sections, is the same as the method illustrated by FIGS. 14 and 14A and is not repeated herein.

As noted above, the material selection for the rollable ridge vent will effect the memory of the polymer, as a more flexible material will not have as much memory as a more rigid material, and thus the orientation of the baffles 214 once the ridge vent is unrolled. Still further, the forming process can also factor into the orientation that the baffles 214 will take once the ridge vent is unrolled. For example, the orientation of the baffles 214 during the formation process can factor into their orientation once cooled, and thus following rolling and unrolling of the ridge vent. Also, stresses can be induced into the polymer material forming the baffles 214, which could even cause the baffles to take an orientation that is greater than 90° relative to the central panel portion 202 once ejected from the mold process, and thus effecting the orientation of the baffles following rolling and unrolling of the ridge vent. One means of inducing these stresses is to cool the baffle portions 214 at a faster rate than, for example, the central panel portion 202. This induced cooling rate difference can be achieved by adding water or other coolant lines proximate to the baffle portions 214 in the mold.

In one embodiment, an internal filter is coupled to the rollable ridge vent. An exemplary filter may be made of an untreated, unwoven fiberglass mesh. The filter may be attached to the vent by a heat staking process by which the support ribs 218 are melted into the filter material along the full length of the product. An exemplary filter is described in, for example, U.S. Pat. No. 6,149,517 to Hansen, the entirety of which is hereby incorporated by reference herein. The filter, of fiberglass mesh construction or the like, is provided beneath the central panel portion 202, for filtering out insects, snow, rain, debris, etc., while allowing sufficient air flow therethrough to accomplish the purposes of the rollable ridge vent.

In one embodiment, the baffles 214 include weep holes (not shown) cut or otherwise formed therein proximate to bottom edges thereof, i.e., the edges that are oriented to rest on the roof shingles. The weep holes allow rainwater to pass through the baffles and drain down the sloped roof. In one embodiment, these weep holes are spaced about every four inches in the baffles 214 and are sized such that they remain open even if the baffles are oriented relative to the central panel portion at an angle less than 90°. In one embodiment, the weep holes are slots of about 0.2" wide and 0.35" high.

In a preferred embodiments, the roof ridge vent can be molded such that the baffles become generally parallel with (e.g., ±30°) the central panel when rolled. The baffles are then orientated in a more vertical position with respect to the central panel portion during installation, either manually or naturally by the shape or design of the baffle itself. Preferably, the baffles default to an installed position once the ridge vent is unrolled.

The baffles can be locked in vertical orientation by the use of clips, adhesive tape, or other securing means. The baffles can also be vertically oriented externally by imposing stresses, or reinforcing ribs, for example, in the right locations during the molding or fabrication of the ridge vent. In this manner, the baffles can be oriented in a flattened position when the vent is rolled, and then they can spring back once the vent is unrolled. These stresses, and/or reinforced portions of the vent, can help insure that the baffle is always naturally in a vertical orientation once installed, thereby reducing instances of improper installation.

Figure 20:
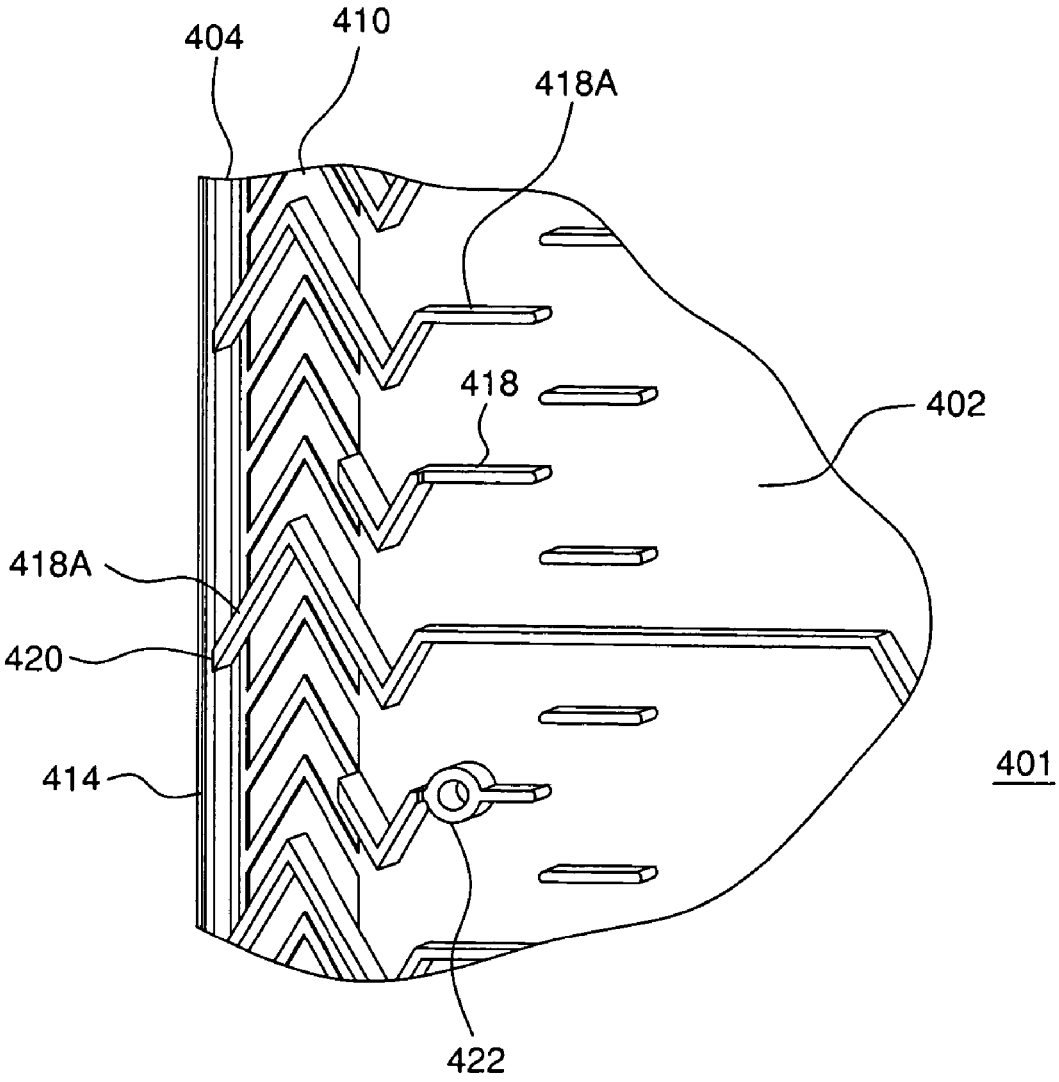
FIG. 20 is a partial, enlarged bottom perspective view of another alternative embodiment of a rollable ridge vent.

In one embodiment, at least some of the support ridges are coupled to the baffles to help return the baffles to a desired orientation, such as perpendicular to the central panel portion, after the central panel is unrolled. FIG. 20 is an enlarged, bottom perspective view of an embodiment of a rollable ridge vent 401. With respect to many features, ridge vent 401 is constructed similarly to the ridge vent 201 described above. Ridge vent 201 has a central panel portion 402, lateral edges 404 with baffles 414 pivotally coupled thereto, and support ribs 418. Nail holes and/or channels 422 can be provided to provide predefined nail or fastener locations. Ridge vent 401 also includes slotted vent opening 410. Unlike the ridge vent 201, ridge vent 401 includes at least one, and preferably more than one, support ribs 418A that are directly coupled to the baffles 414 and engage baffles 414. Support ribs 418A are preferably molded to the side walls of the baffles 414, and not any portion of underside of top central panel portion 402 proximate to lateral edges 404. However, for manufacturability purposes, in one embodiment, support ribs 418A are coupled to both the inside side wall of baffles 414 and the central panel portion 402 at the lateral edges 404, more specifically at the interior corners 420 formed by each baffle 414 and the bottom surface of the central panel portion 402. Support ridges 418A are preferably shaped as a spring, such as the accordion shape shown in FIG. 20, and as such extend when the baffles 414 are flexed to a more horizontal position when the rollable ridge vent 401 is rolled as described above. The support ribs 418A provide spring tension to pull the baffle back towards a more vertical orientation (as shown) when the ridge vent 401 is unrolled. When the support ribs 418A are coupled to both the inside wall of a baffle 414 and the central panel portion 402 at the lateral edge 404 as shown, the support ribs both extend and twist when the baffles 414 are flexed to a more horizontal position relative to the central panel portion 404.

From the foregoing, it can be realized that this invention provides improved roof vents, methods of installation, and methods of manufacture. The roof vents of this invention have adjustable baffles, which can be laid flat for easier manufacturing and rolling, but which can be oriented in a vertical direction for providing negative pressure. Although various embodiments have been illustrated, this is for the purpose of describing, but not limiting the invention. Various modifications which will become apparent to one skilled in the art, are within the scope of this invention described in the attached claims.

What is claimed is:

1. A rollable ridge vent for covering an opening of a roof ridge, comprising:

an elongated flexible member having a central panel portion, a pair of lateral edges and a pair of transverse ends;

a pair of vent openings disposed proximate to said lateral edges;

said central panel portion comprising a plurality of support ribs for supporting said central panel portion above said roof;

a pair of baffles disposed laterally from said vent openings and said lateral edges;

each of said baffles being oriented in a first direction relative to said central panel portion for at least a period of time prior to installation and being oriented in a second direction relative to said central panel portion after said installation.

2. The ridge vent of claim 1, wherein said pair of baffles are pivotally coupled to said lateral edges.

3. The ridge vent of claim 2, wherein said time prior to installation is when said ridge vent is rolled, and in said first direction said baffles are oriented substantially parallel to a major portion of a top surface of said central panel portion.

4. The ridge vent of claim 2, wherein said second direction is more vertical than said first direction.

5. The ridge vent of claim 4, wherein said baffles are oriented at an angle between about 45–90° relative to said central panel portion when in said second direction.

6. The ridge vent of claim 1, wherein said central panel portion has a generally planar top major surface between said lateral edges when unrolled, and wherein said pair of vent openings are formed through said central panel portion, inward of said lateral edges.

7. The ridge vent of claim 1 wherein said central panel portion is bi-axially flexible.

8. The ridge vent of claim 1 further comprising support means for assisting said baffles to be maintained in said second direction.

9. The ridge vent of claim 8 wherein said support means comprises at least one fastener associated with each baffle.

10. The ridge vent of claim 1, wherein said baffles are pivotally coupled to said lateral edges and have a height greater than said support ribs, wherein when said baffles are oriented in said second direction said baffles are at an angle less than 90° to said central panel portion.

11. The ridge vent of claim 1, wherein said baffles each comprise a pliable portion thereof at a bottom end thereof which is conformable to contours in said roof upon installation.

12. The ridge vent of claim 11, wherein said baffles each comprise a main body portion to which said pliable portions are connected, wherein said pliable portions are thinner than said main body portion.

13. The ridge vent of claim 1, wherein said time prior to installation is when said ridge vent is rolled, wherein at least some of said support ribs from said plurality of support ribs are directly coupled to said baffles, said at least some of said support ribs shaped to provide spring tension to pull the baffles to said second direction, said second direction being more vertical than said first direction relative to said central panel portion.

14. A method of installing a ridge vent over an opening of a roof ridge, comprising:

providing a ridge vent comprising:

an elongated flexible member having a central panel portion, a pair of lateral edges and a pair of transverse ends;

a pair of vent openings disposed laterally from said lateral edges;

said central panel portion comprising a plurality of support ribs for supporting said central panel portion above said roof; and a pair of baffles disposed laterally from said vent openings and said lateral edges;

covering an opening of a roof ridge with said ridge vent;

orienting said baffles from a first direction to a second direction relative to said central panel portion; and affixing said ridge vent to said roof ridge so as to allow air to escape from beneath said central panel portion to ventilate a space beneath said roof.

15. The method of claim 14, wherein said orientation step comprises employing support means for assisting said baffles to maintain said second position.

16. The method of claim 14, wherein said baffles are oriented from said first direction to said second direction either manually with clips or fasteners, by employing a tendency of the flexible member to orient itself after being unrolled, or a combination thereof.

17. The method of claim 14 further comprising disposing a plurality of shingles over a portion of said ridge vent.

18. The method of claim 17 further comprising nailing through a portion of said shingles and said roof vent to secure said shingles and said roof vent.

19. The method of claim 14, wherein said pair of baffles are pivotally coupled to said lateral edges, and wherein when in said first direction said ridge vent is rolled and said baffles are oriented substantially parallel to a major portion of a top surface of said central panel portion.

20. The method of claim 14, wherein said second direction is more vertical than said first direction.

21. The method of claim 20, wherein said baffles are oriented at an angle between about 45–90° relative to said central panel portion when in said second direction.

22. The method of claim 14, wherein said baffles each comprise a pliable portion thereof at a bottom end thereof which is conformable to contours in said roof upon installation, said method further comprising the step of conforming at least a portion of said pliable portion to contours in said roof.

23. A rollable ridge vent for covering an opening of a roof ridge, comprising:

an elongated flexible member having a bi-axially flexible central panel portion, a pair of lateral edges and a pair of transverse ends, said central panel portion being generally planar when unrolled;

a pair of slotted vent openings formed through said central panel portion and inward of said lateral edges;

a pair of baffles pivotally connected to said lateral edges for directing air current;

said central panel portion comprising a plurality of descending support ribs for supporting said central panel portion above said roof;

said baffle of each side portion being oriented in a first direction relative to a proximate part of said central panel portion when rolled, and being oriented in a second direction relative to said proximate part of said central panel portion after said installation on said roof ridge.

24. The ridge vent of claim 23 wherein said central panel portion is further supported by an internal, integral corrugated gusset.

25. The ridge vent of claim 23, wherein said ridge vent further comprises a filter coupled thereto.

26. The ridge vent of claim 23, wherein said baffles are oriented substantially parallel to a major portion of a top surface of said central panel portion when oriented in said first direction.

27. The ridge vent of claim 26, wherein said baffles are oriented at an angle between about 45–90° relative to said central panel portion when in said second direction.

* * * * *